US005373350A

United States Patent [19]

Taylor et al.

[11] Patent Number: 5,373,350

[45] Date of Patent: Dec. 13, 1994

[54] XEROGRAPHIC/THERMAL INK JET COMBINED PRINTING

[75] Inventors: Thomas N. Taylor; LeRoy A. Baldwin, both of Rochester; Otto R. Dole, Walworth, all of N.Y.

[73] Assignee: Xerox Corporation, Stamford, Conn.

[21] Appl. No.: 171,728

[22] Filed: Dec. 22, 1993

Related U.S. Application Data

[63] Continuation of Ser. No. 877,502, May 1, 1992, abandoned.

[51] Int. Cl.[5] ..... G03G 21/00

[52] U.S. Cl. ..... 355/202; 346/157; 346/160

[58] Field of Search ..... 355/200, 202, 218, 326 R; 346/157, 160; 395/104

[56] References Cited

U.S. PATENT DOCUMENTS

| | | | |
|---|---|---|---|
| 4,167,324 | 9/1979 | Wu | 355/202 |
| 4,373,799 | 2/1983 | Snelling et al. | 355/202 |
| 4,385,822 | 5/1983 | Kanbe | 355/218 X |
| 4,551,008 | 11/1985 | Banton | 355/202 |
| 4,587,536 | 5/1986 | Saito et al. | 346/160 |
| 4,774,546 | 9/1988 | Corona et al. | 355/244 |
| 4,887,128 | 12/1989 | Jamali et al. | 355/202 |
| 4,942,427 | 7/1990 | Rakov et al. | 355/202 |
| 4,965,635 | 10/1990 | Rushefsky | 355/202 X |
| 4,969,013 | 11/1990 | Tsilibes | 355/202 X |
| 4,972,271 | 11/1990 | Koumura | 355/202 X |
| 5,038,218 | 8/1991 | Matsumoto | 358/296 |
| 5,081,596 | 1/1992 | Vincent et al. | 395/104 |
| 5,138,465 | 8/1992 | Ng et al. . | |

OTHER PUBLICATIONS

May 1980 IBM Technical Disclosure Bulletin, vol. 22, No. 12. Entitled "Electrophotographic Printer With an Ion Writing Station Therein"; T. Young pp. 5270–5271.

*Primary Examiner*—Fred L. Braun

*Attorney, Agent, or Firm*—Oliff & Berridge

[57] ABSTRACT

A printer combines the technologies of xerographic and thermal ink jet printing into a unit which is capable of high resolution text and color graphics. The printer is capable of forming a composite image including a xerographic printing portion and a Thermal Ink Jet (TIJ) printing portion by printing the xerographic portion using known xerographic techniques and the thermal ink jet portion by a thermal ink jet printing array associated with the printer. The portions may be printed in any order and may be dried by a drying station after printing of each portion or after both portions have been printed. At least one thermal ink jet printing array can serve as an annotator which is capable of printing additional information onto a copy such as company letterhead, special instructions, addresses or the like.

11 Claims, 9 Drawing Sheets

XEROGRAPHIC/THERMAL INK JET COMBINED PRINTING

This is a continuation of application Ser. No. 07/877,502 filed May 1, 1992, now abandoned.

BACKGROUND OF THE INVENTION

1. Field of the Invention

The present invention relates to a method and apparatus for providing high resolution color images using xerographic and thermal ink jet technology and more particularly, to an annotator for adding additional information to copies wherein the annotator is a low cost color thermal ink jet printer.

2. Description of Related Art

As known to those skilled in the copier arts, it is often necessary to add certain information such as instructions, caveats, names, addresses, and the like to copies being produced by a copier or reproduction machine. This information, which does not appear on the original image, is usually placed in some non-image area, typically the copy margin.

Known references which form composite images include U.S. Pat. No. 4,167,324 which discloses a technique whereby a latent image of an original document is formed on a photoreceptor by a light lens system along a first optical path while a modulated light beam input is directed along a second optical path to the surface of a belt. The belt provides a charge pattern on a previously formed latent image in conformity with information in the modulated laser input.

U.S. Pat. No. 4,385,822 discloses formation of a composite image whereby an electromagnetic recording medium is used to form a first electrostatic latent image in one layer thereof, and a second magnetic latent image in a second layer thereof.

IBM Technical Disclosure Bulletin, Vol. 22, No. 12, May 1980, pp. 5270–5271 discloses a composite image forming technique whereby a latent electrostatic image of an original is formed by a light/lens optical system. At a downstream position, an ion writing station deposits a selected charge pattern on an already discharged portion of the latent image.

U.S. Pat. No. 4,774,546, assigned to the same assignee as the present invention, discloses an apparatus for forming a composite image comprising an annotator including an illumination source, an addressable light modulation device such as a liquid crystal panel and a lens array for forming a modulated light pattern onto a photosensitive surface.

U.S. Pat. No. 4,551,0080 assigned to the same assignee as the present invention, discloses an image annotator having an array of flexible light reflecting fingers individually actuatable to create an annotated image within borders of a copy image.

U.S. Pat. No. 5,038,218 discloses an image processing assembly which combines digital copier image data and electronic data from an external source, stores the combined data in a memory, performs resolution and orientation conversions, and prints out the combined images utilizing a single printer.

These prior art techniques are subject to various problems and suffer from various disadvantages. The laser modulated systems are very expensive and require significant space. The ion generator and electromagnetic techniques are costly to implement and require stringent alignment procedures. These techniques do not allow color annotating, without use of a color copier since both images are formed on a belt surface of the copier by charging or recharging portions of the surface and developing by the copier. Additionally, these usually require discharging the photoreceptor belt in portions where the annotated data is to be placed, followed by recharging of the portions prior to imaging of the annotated data. None of the prior known art provides a high-quality, low cost color annotator which utilizes thermal ink jet printing technology to provide color annotating and color composite images irregardless of the type of xerographic system used.

Thus, there is a need for a low cost annotator capable of color image printing which can be utilized with a copier or duplicator to provide a high-quality composite image onto a copy sheet. Additionally, there is a need for a low cost annotator which includes the advantages of thermal ink jet printing.

OBJECTS AND SUMMARY OF THE INVENTION

It is an object of the present invention to provide a printing system capable of printing an annotated image comprising a xerographic portion and a thermal ink jet portion.

It is another object of the present invention to provide color composite images without requiring use of a color copier.

It is another object of the present invention to provide improved color in a composite image by utilizing a high resolution 600×600 SPI xerographic print engine for forming black portions of an image and a color thermal ink jet for producing colored portions.

It is yet another object of the present invention to print the image in inverted black outline with colored centers to improve impression for a lower resolution thermal ink jet on a high resolution xerographic engine.

In accordance with the invention, low cost, low maintenance expense annotator capabilities are provided to a copier which is simple and easy to use and operate. The copier is capable of reproducing an original using a xerographic technique and xerographic apparatus as known in the art and includes a thermal ink jet printing array associated with the copier to provide moderate to high resolution color annotation capabilities to the copier.

The annotator includes a thermal ink jet printing array which receives data representing annotated image data from a storage means associated with the copier or an external source such as a computer or the like. The data may represent company letterhead, caveats, instructions, and the like.

These and other objects will become apparent from a reading of the following detailed description in connection with the drawings.

BRIEF DESCRIPTION OF THE DRAWINGS

The invention will be described in detail with reference to the following drawings wherein.

DETAILED DESCRIPTION OF PREFERRED EMBODIMENTS

Figure 1:
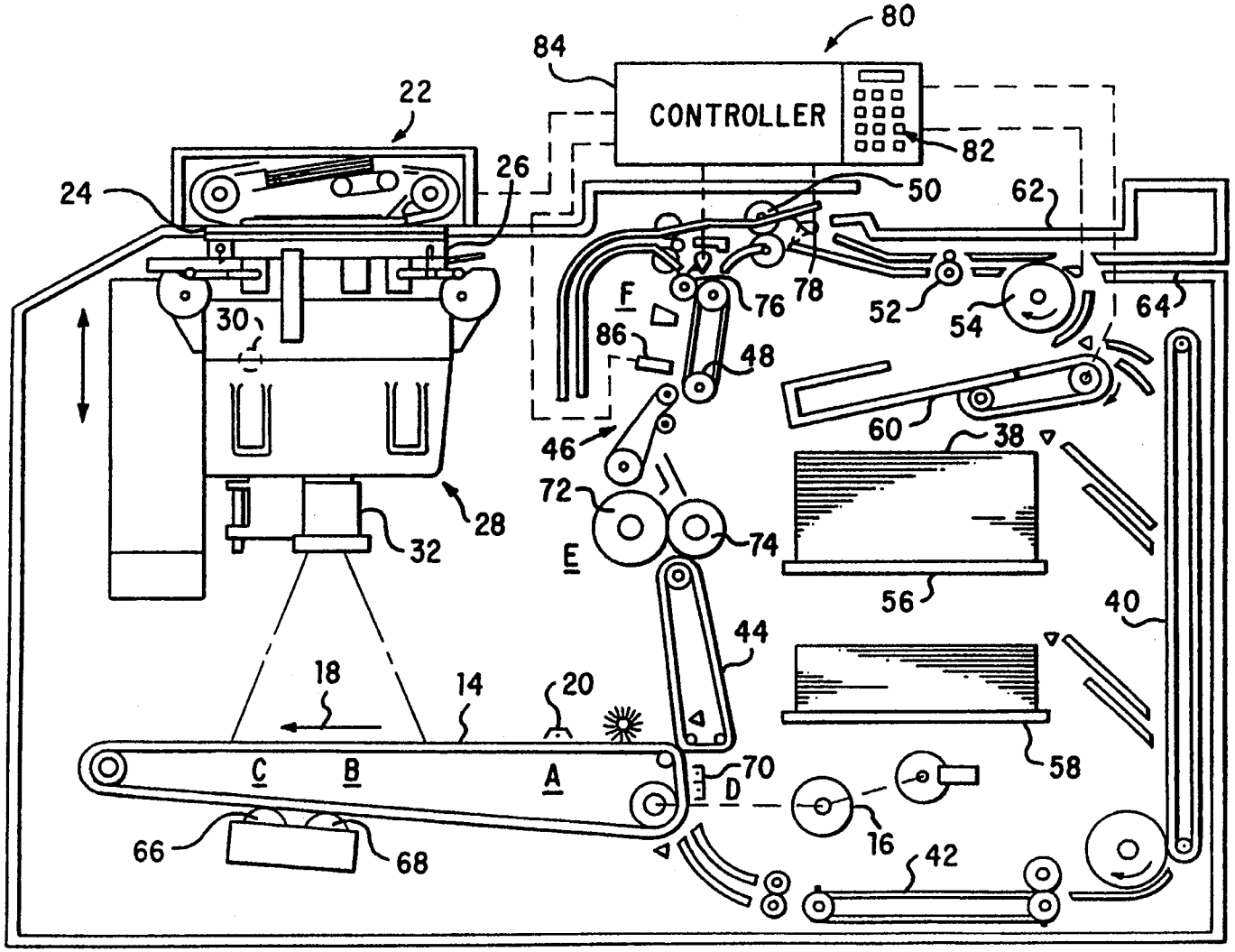
FIG. 1 is a plan view of a reproduction machine adapted to incorporate an annotator according to an embodiment of the present invention.

FIG. 1 schematically depicts the various components of an illustrative electrophotographic copying or printing machine (copier) 10 incorporating an annotator. Inasmuch as the art of electrophotographic copying is well known, the various processing stations employed in the copier 10 will be shown and briefly described with reference thereto.

The illustrative xerographic copier 10 employs a recording member in the form of a belt 14 having composite photoconductive layers thereon. The belt 14 is driven by a main motor 16 and moves in the direction of arrow 18 to advance successive portions of the photoconductive surface through various processing stations disposed about a path of movement thereof.

A portion of the photoconductive surface passes through a charging station A. A corona generating device 20 charges the photoconductive surface of belt 14 to a relatively high substantially uniform potential. Then, the charged portion of the photoconductive surface is advanced through an imaging station B. A document handling unit 22 then positions an original document 24 facedown on a platen 26 over an exposure system 28. The exposure system 28 includes a lamp 30 which illuminates the document 24 positioned on the platen 26. Light rays reflected from the original document 24 are transmitted through a lens 32 onto the previously charged photoconductive surface of the belt 14 supplying first data signals representing the original to the belt and selectively dissipating charge thereon. This records a xerographic image 34 on the photoconductive surface which corresponds to information areas contained within the original document 24. Then, belt 14 advances the xerographic latent image 34 recorded onto the photoconductive surface of belt 14 to development station C.

A plurality of sheet transports provide a transport path for transporting of a copy sheet 38 from one or more stacks located at entrances to the transport path, through the various processing stations and on towards one or more output trays located at exits of the transport path. In this particular example, the sheet transport path comprises a vertical transport 40, a registration transport 42, a prefuser transport 44, a decurler 46, a post fuser transport 48, an output transport 50, a bypass transport 52, and an inverter roll 54. The copy sheet 38 can be fed from either a main tray 56, an auxiliary tray 58 or a duplex tray 60 through the copier 10 to either a top output tray 62 or a discharge path 64. The transports are driven by suitable drive means.

At development station C, a pair of magnetic brush developer rollers 66, 68 advance a developer material into contact with the xerographic image. The xerographic latent image attracts toner particles from carrier particles of the developer material to form a toner powder image on the photoconductive surface of the belt 14.

After developing, belt 14 advances the toner powder image to transfer station D. At transfer station D, copy sheet 38 is moved into transfer relation with the toner powder image. A corona generating device 70 at station D sprays ions on the backside of the copy sheet 38 to attract the toner powder image from the photoconductive surface of the belt 14. After transfer, the copy sheet 38 advances to a fusing station E through the prefuser transport 44.

Fusing station E includes a fuser roller 72 and a backup roller 74. The copy sheet 38 passes between the rollers 72, 74 with the powder image contacting fuser roller 72. This permanently fixes the powder image to the sheet. After fusing, decurler 46 and post fuser transport 48 carry the copy sheet 38 to an inverter gate 76 which either feeds the copy sheet 38 into inverter roll 54 or to bypass gate 78. From the bypass gate 78, the copy sheet 38 can be directed to top output tray 62 or to bypass transport 52 which then feeds the copy sheet 38 to duplex storage tray 60 for subsequent processing on a reverse side.

A controller 80 for controlling the copier 10 is provided at a convenient location on or adjacent to the copier 10. The controller 80 includes a suitable control panel 82 to enable the user to operate the copy run desired and monitor operations of the copier 10. A control system 84 in the controller 80 includes one or more microprocessors and various memories to control operation of the various components of the copier 10 and to control synchronizing and timing of the components.

Figure 2:
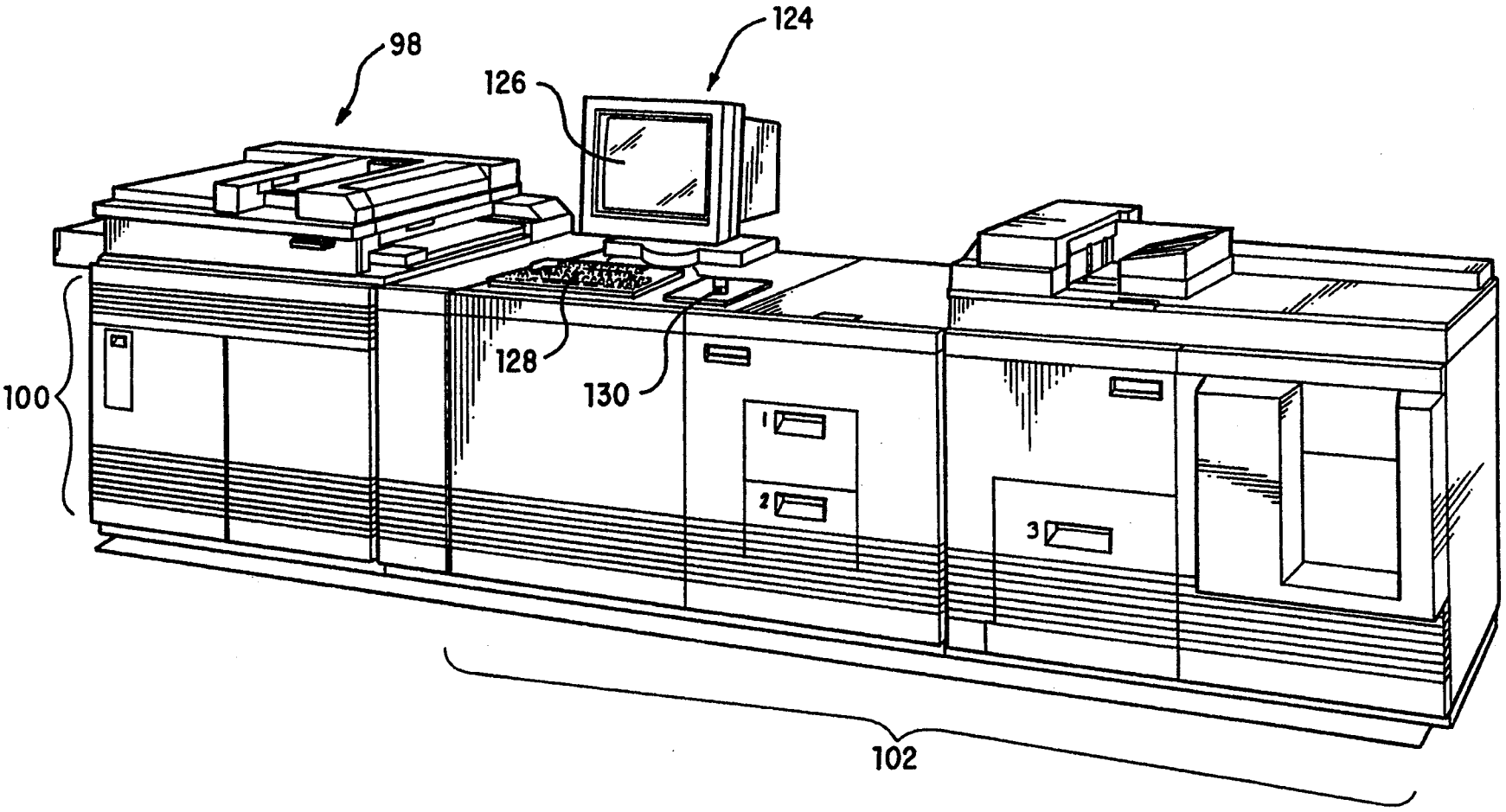
FIG. 2 is a view depicting an electronic printing system.
Figure 3:
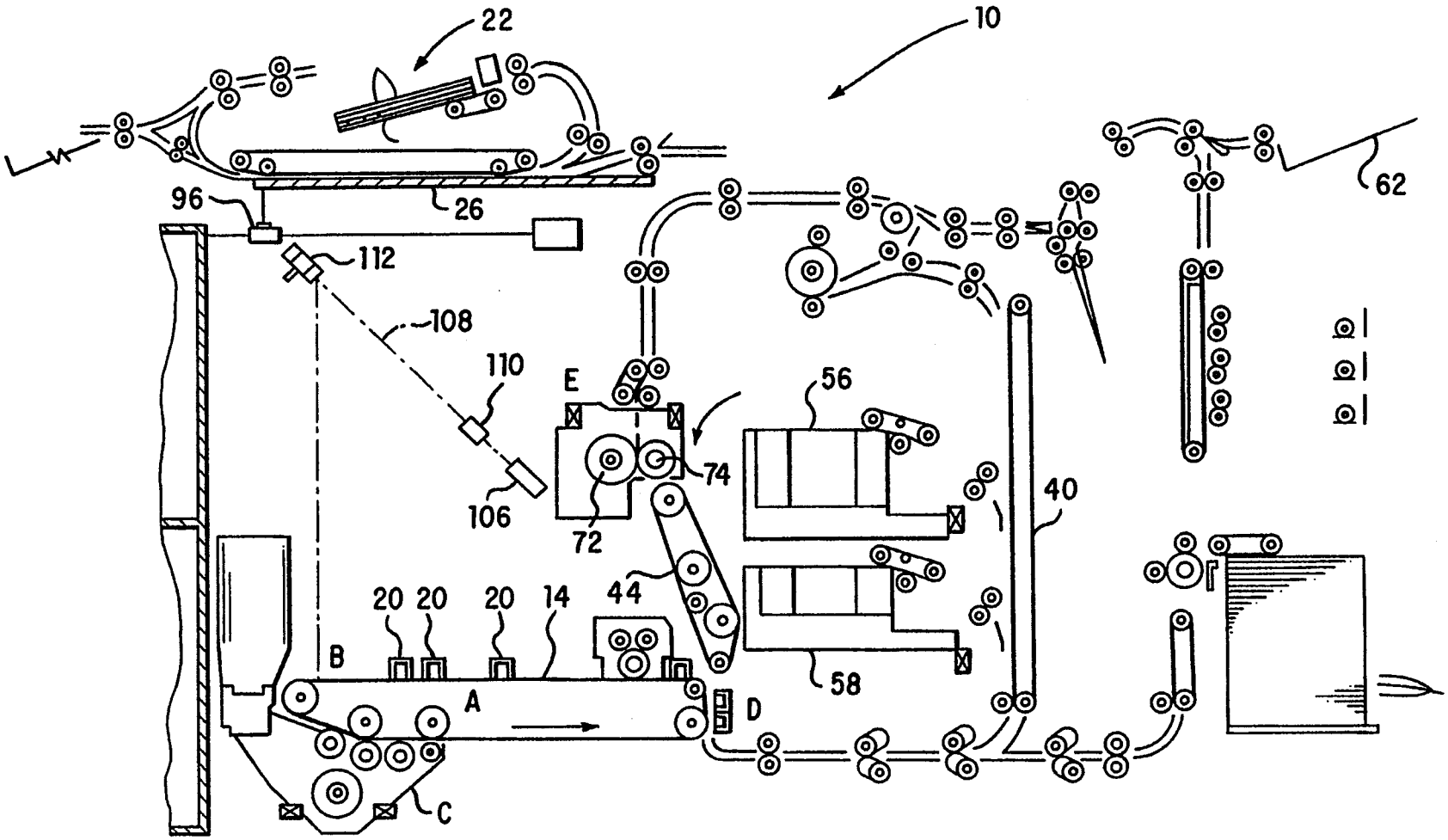
FIG. 3 is a plan view of the electronic printing system of FIG. 2.
Figure 4:
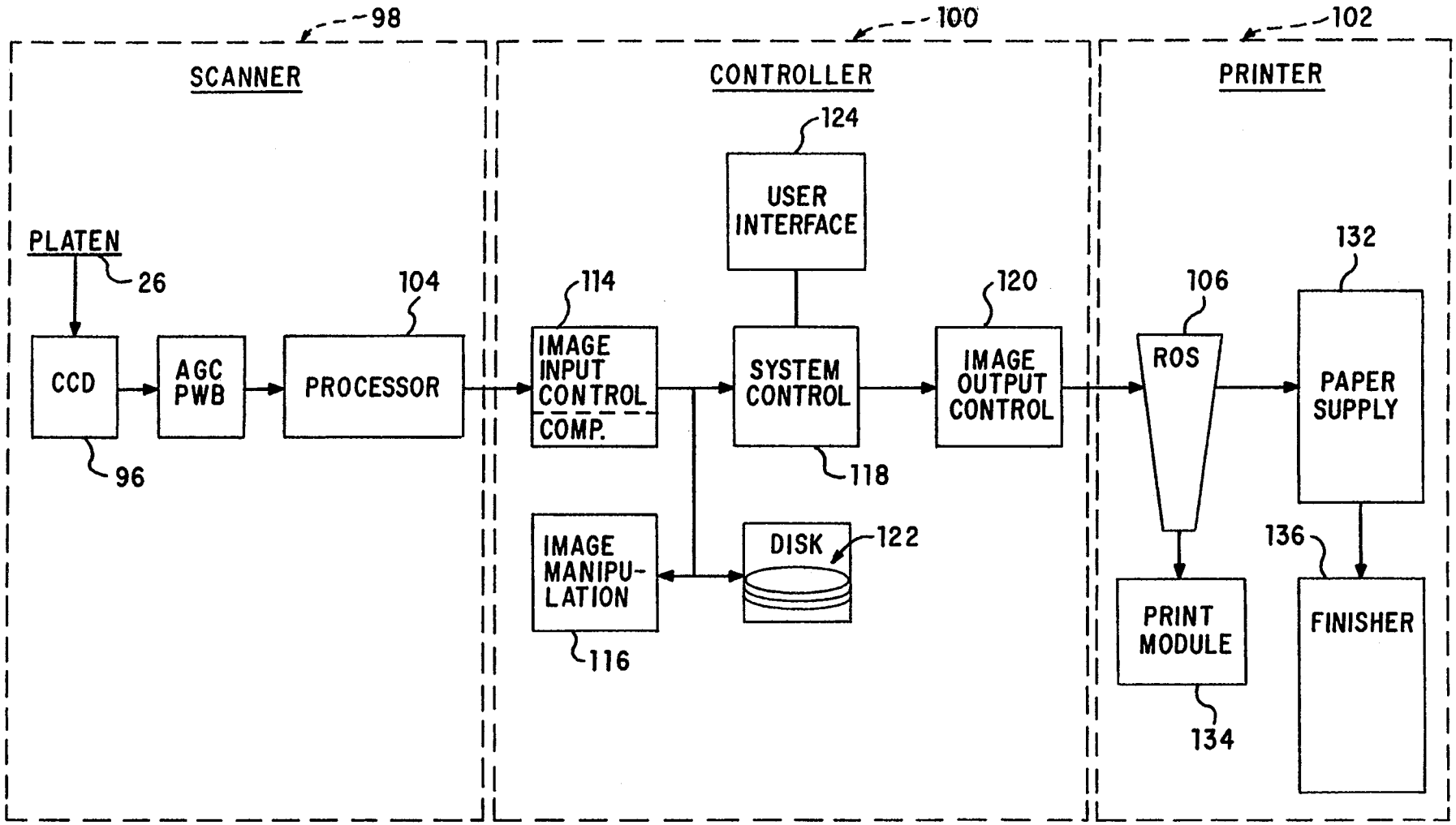
FIG. 4 is a block diagram of the major elements in the printing system shown in FIG. 3.

Referring to FIGS. 2–4, there is shown an exemplary laser based printing system for processing print jobs in accordance with the present invention. This type of printer, or copier 10, is capable of printing simplex or duplex copy sheets from originals by scanning the originals using a scanning array 96 which supplies first data signals, storing the first data signals representing information in digital form and printing the data on the copy sheets 38. This type of printer comprises three main sections: a scanning section or Image Input Terminal (IIT) 98, a controller section or Electronic Sub-System (ESS) 100, and a printer section or Image Output Terminal (IOT) 102. This printing system is similar to the previous example in many respects. It includes a similar transport path and a photoreceptor belt 14 having a charging station A, an imaging station B and a developing station C located thereon. This printing system also includes a transfer station D and a fuser station E as in the prior example. The scanning section 98 scans the original located on the platen 26 and provides image signals or pixels representative of the image scanned and sends them to a processor 104. A difference in this system is that the signals are not directly sent for imaging. Instead, the processor 104 converts the analog image signals output by the scanner to digital image signals. The processor 104 also provides enhancements and changes to the image signals such as filtering, thresholding, reduction, etc. These digital signals are contained within an electronic memory within the copier 10.

The specific way in which the image is presented to the belt and developed is also different. The printer section includes a Raster Output Scanner (ROS) 106 having a laser beam 108, the beam 108 being split into two imaging beams by a modulator 110 in accordance with the content of the image signal. The beams 108 are scanned across moving photoreceptor belt 14 by mirrored facets of a rotating polygon 112 to expose two image lines on the photoreceptor belt 14 at imaging station B with each scan to create latent images 34 representing first data signals. The photoreceptor belt 14 is uniformly charged by charging station A prior to the scanning of the beams 108. The latent images 34 are developed by developing station C and transferred at transfer station D. For transfer, copy sheet 38 is brought forward in timed registration with the developed image on the photoreceptor from any of numerous paper trays. Then, the developed image transferred to the copy sheet is fused and output at an output tray.

The controller section 100 is divided into an image input controller 114, an image manipulation section 116, a system control 118, an image output control 120, an electronic storage medium 122 and a User Interface (UI) 124. The UI 124 includes a combined operator controller/CRT display consisting of an interactive touchscreen 126, keyboard 128 and mouse 130. The UI 124 allows an operator to instruct, modify, and program print jobs. In accordance with the present invention, this UI 124 includes controls to select and control printing of an annotated image onto copy sheet 34 by annotator 86 which may be located anywhere along the transport path.

With specific reference to FIG. 4, the printing system components are diagrammatically shown. The printer section (IOT) 102 includes the ROS 106, a plurality of paper supplies generally referenced as 132, a print module 134 and a finisher 136.

Specific examples of preferred locations of the annotator 86 are described in the following embodiments, of which reference is given to the machine of FIG. 1. Although the examples equally apply to the machine of FIG. 2 the examples will be discussed with reference to one machine to simplify the description. It will become evident from the following discussion that the invention is equally well suited for use in a variety of other printing and copying machines, and is not limited in its application to the particular machines or embodiments as shown herein.

Figure 8:
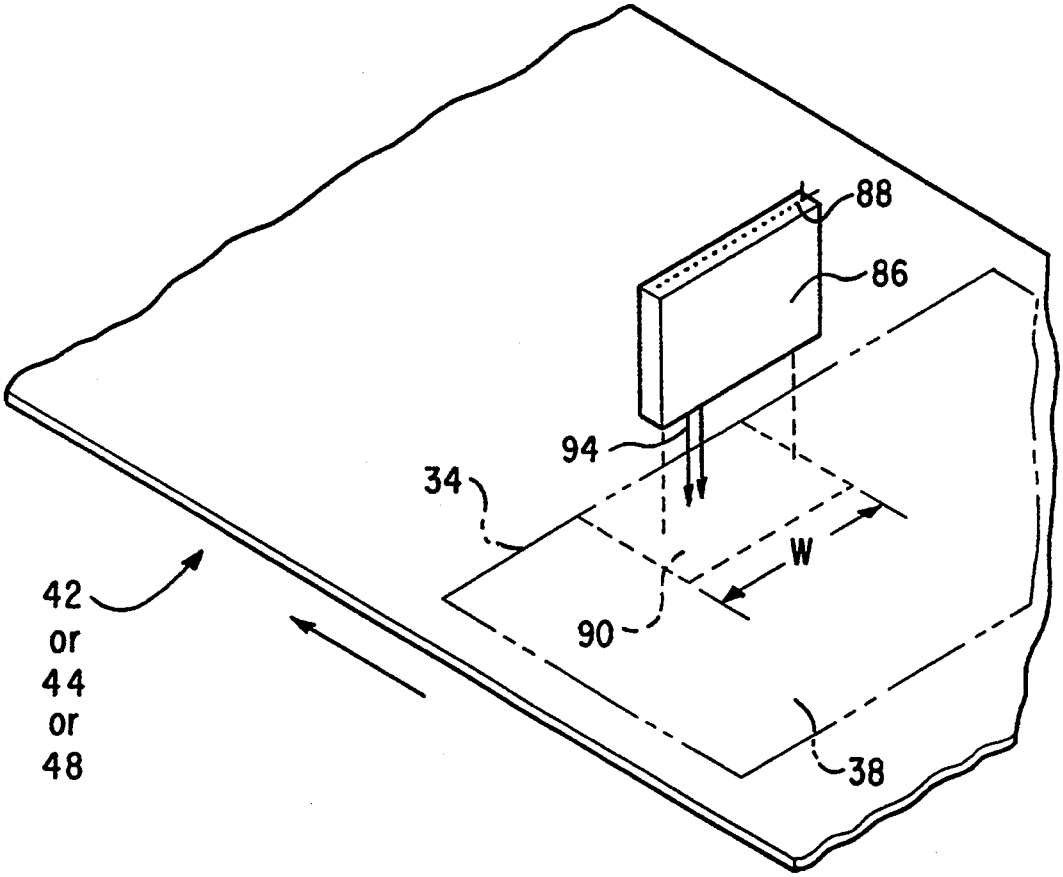
FIG. 8 is an enlarged isometric view of the annotator shown in FIG. 1.

According to a first embodiment of the present invention, as shown in FIG. 1, an annotator 86 comprising a thermal ink jet printing array 88 (see FIG. 8) is located along the transport path after the fuser station E and prior to top output tray 62 or discharge path 64. In this embodiment, the thermal ink jet printing array 88 is preferably located adjacent and transverse to the longitudinal direction of post fuser transport 48. The annotator 86 receives second data signals representing an annotated image from a suitable memory in the copier 10 itself or from an external supply source such as a computer connected through an appropriate interface. The thermal ink jet printing array 88 is controlled by the controller 80 for the copier 10 and prints an annotated image 90 (FIG. 8) through individual jets of the array 88 onto the copy sheet 38 at predetermined locations as the copy sheet 38 passes through the post fuser transport 48, with the controller 80 receiving timing signals to control the printing thereof from sensors within the copier 10. The specifics on controlling the printing of a thermal ink jet are well known in the art and will not be discussed in detail.

After annotated image printing by the thermal ink jet array 88, the copy sheet 38 is advanced through the inverter gate 76 as previously described. In this embodiment, the heat from the adjacent fusing station E usually can provide enough energy to dry the ink from the annotator 86. Optionally, a drying station F may be included immediately after the post fuser transport 48 to dry the annotated image 90 prior to further handling.

Figure 5:
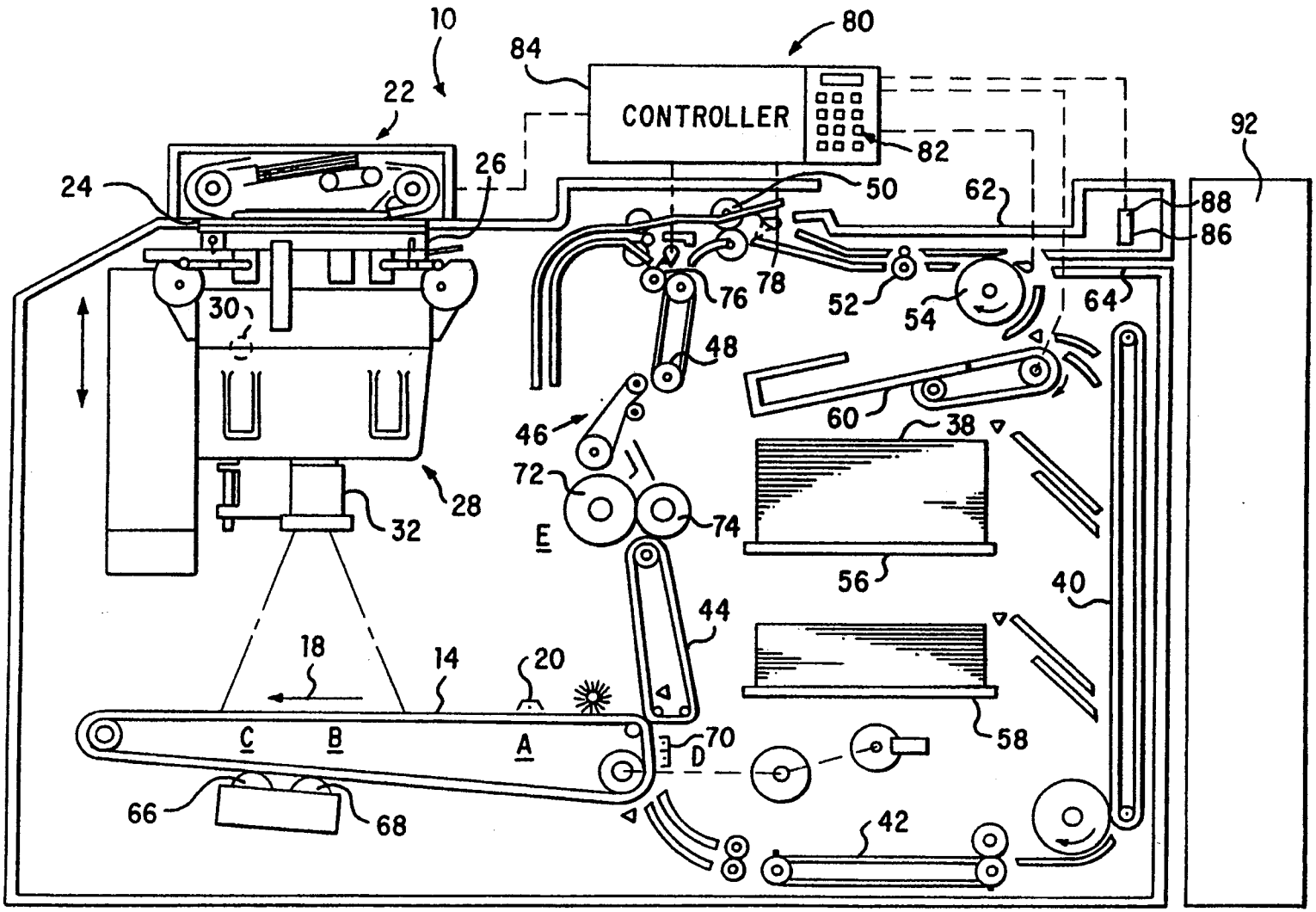
FIG. 5 is a plan view of the reproduction machine of FIG. 1 adapted to incorporate an annotator according to an alternative embodiment of the present invention.

Alternatively, as shown in FIG. 5, the annotator 86 may be located on a separate housing adjacent to the paper path communicating with the discharge path 64 of the copier 10 such that the copy sheet 38 exits the inverter gate 76 and passes by the annotator 86 for annotator imaging. Then, after printing of the annotated image 90, the copy sheet 38 can then be advanced to an appropriate outlet tray or further advanced to a sheet sorter, sheet collator or sheet stacker 92.

Figure 6:
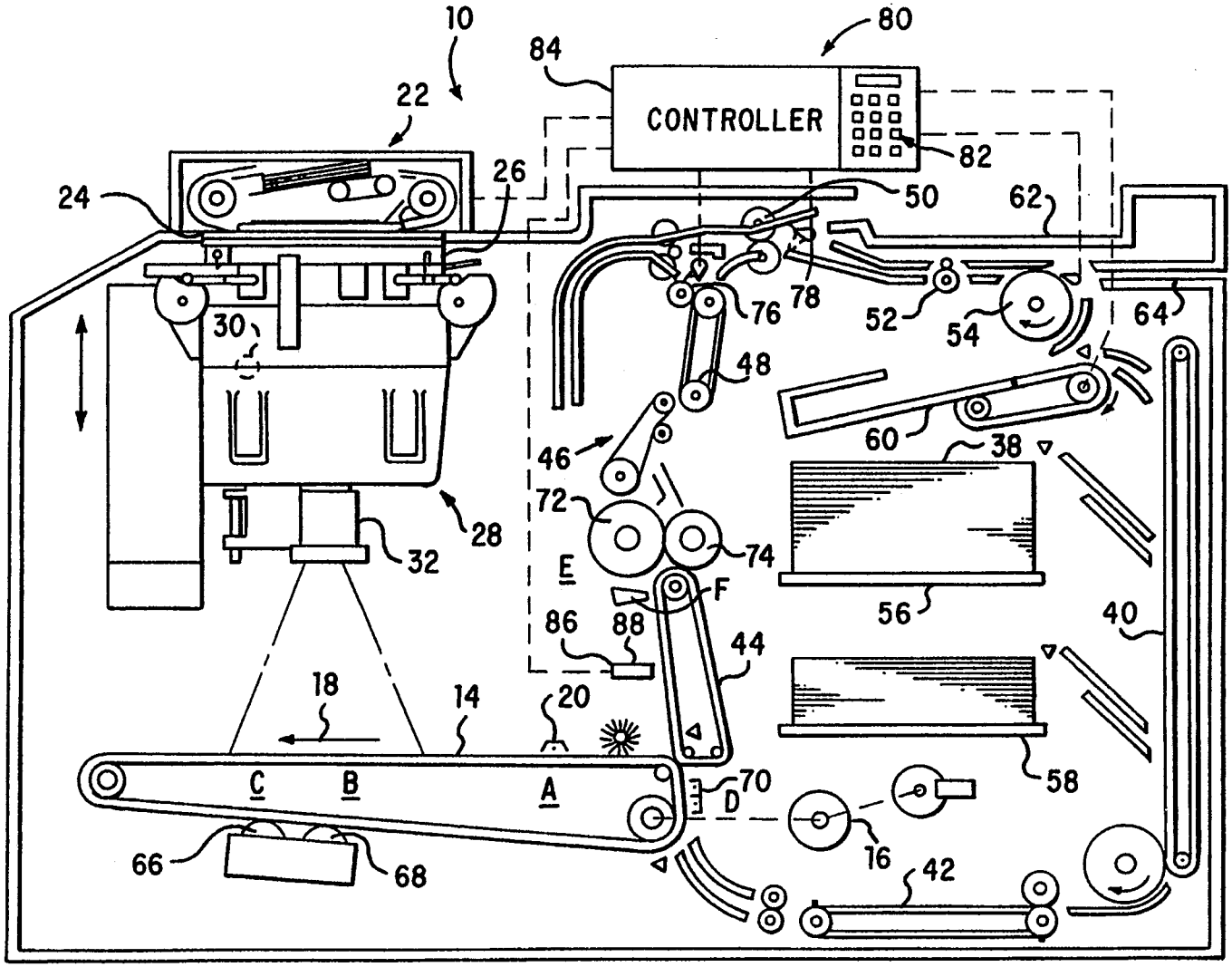
FIG. 6 is a plan view of the reproduction machine of FIG. 1 adapted to incorporate an annotator according to another alternative embodiment of the present invention.

According to another embodiment of the present invention, the thermal ink jet printing array 88 of annotator 86 is located adjacent to transfer station D, as shown in FIG. 6. In this embodiment, the annotator 86 is transverse to the longitudinal axis of the prefuser transport 44. The annotator 86 receives appropriate control signals from the controller 80 to control printing of annotated image signals received from memory onto the copy sheet 38 immediately after the copy sheet 38 has been transferred at station D and prior to fusing by fuser roller 72 and backup roller 74. The fuser roller 72 and backup roller 74 may provide all of the fusing and drying of the copy sheet 38 having a xerographic image 34 and a thermal ink jet annotated image 90 thereon or an optional drying station F may be provided near the prefuser transport 44 to dry the annotated image 90 and partially heat and condition the xerographic image 34 prior to fusing. The drying station F may include a hot air dryer which blows hot air immediately across the copy sheet 38 as it passes thereby. In this embodiment, the annotator is capable of shooting ink through the transferred toner on the copy sheet 38. This is highly desirable and cannot be done after the xerographic image 34 has been fused. In particular, this covers any misregistration that may occur between the two images. By thickening the outline xerographic image, the annotated fill image which has been inverted can be overfilled such that it extends slightly into the xerographic image. This overfill area blends in with the xerographic image since the ink is capable of shooting through the toner. By slightly overfilling, any slight misregistration should not result in missed coverage or blank areas between the images.

Figure 7:
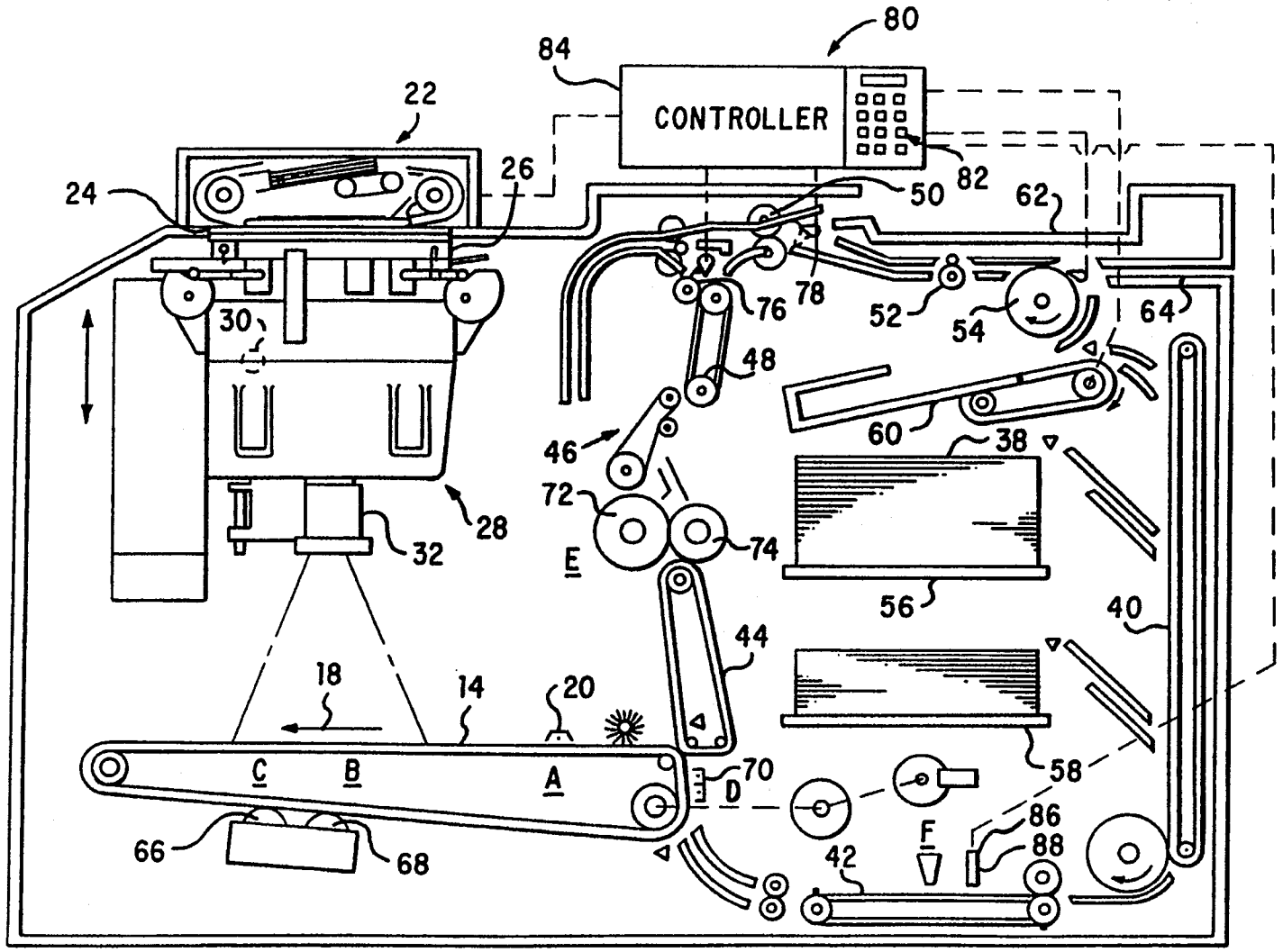
FIG. 7 is a plan view of the reproduction machine of FIG. 1 adapted to incorporate an annotator according to yet another alternative embodiment of the present invention.

According to another embodiment of the present invention, as shown in FIG. 7, the annotator 86 is located along the transport path prior to transfer station D, such that the annotated thermal ink jet image 90 is applied prior to forming of the xerographic image 34. This may be done by locating the thermal ink jet printing array 88 adjacent and transverse to the registration transport 42. In this embodiment, the annotator 86 receives data from memory representing annotated data to be printed onto copy sheet 38. The annotator printing is controlled by controller 80 which senses timing and registration of the copy sheet 38 as it passes through the registration transport 42. The copy sheet 38 now containing an annotated image 90 thereon is advanced past transfer station D where xerographic image 34 is applied. The annotated image 90 may be allowed to air dry or drying may be expedited by a dryer station F being located downstream from the annotator 86. If the dryer station F is located near the transfer station D, the dryer station should be of the type which heats the surrounding area by way of conduction heat rather than forcing air flow past the copy sheet. This is due to the close proximity of the dryer station F with the transfer station D which may cause inconsistencies or inaccuracies of the transfer from air currents produced thereby.

In all embodiments, the annotator 86 may comprise any sort of thermal ink jet printing device, so long as it includes appropriate control apparatus as known in the art to operate properly. The thermal ink jet printing array 88 may consist of a small array which traverses across a carriage, but this arrangement slows down processing and increases control hardware since the copy sheet 38 will have to be intermittently advanced and stopped to allow traversal of the array 88 across the copy sheet 38 for each line or lines covered by the array 88. This may be cost effective if only a limited number of lines or area of annotated image 90 is present. A preferred alternative would be the use of a wide array 88 (shown in FIG. 8) having a width W which is capable of printing by expelling ink droplets 94 across a required width of the copy sheet such that the copy sheet can be advanced at a processing speed consistent with the limits of the thermal ink jet printing array. If the annotated image 90 is to be produced on only a small portion of copy sheet 38, the width W of the array 88 can be reduced. If the annotated image may be located anywhere on the copy sheet 38, a full width array 88 spanning the entire width of the copy sheet 38 would be preferred. Suitable control of transport speed is accomplished by the controller 80 based on operating parameters of the specific type of thermal ink jet printing array 88 used. In addition, the use of multiple annotators 86 may be employed. These could be in multiple locations for printing various second images on the copy sheet 38 or may comprise ganged together annotator arrays. Alternatively, the annotator 86 may be movable to multiple locations during intercopy spacing of pages or between jobs. Preferably, the annotated image is printed in inverted black outline, i.e., black outline with white or colored centers to increase resolution. This in effect improves resolution since borders or outlines of images are printed with the currently higher resolution xerographic process and the inner fill areas are printed using the annotator.

Figure 9:
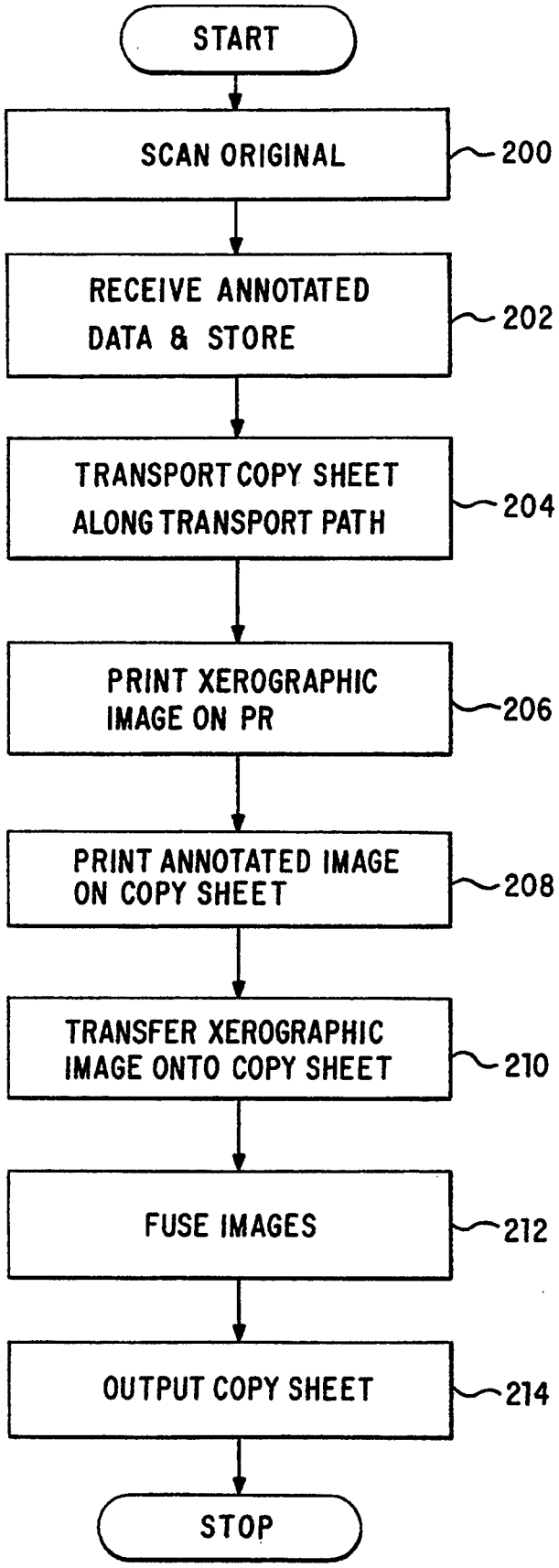
FIG. 9 is a block diagram of composite imaging steps utilized in one embodiment.

FIG. 9 shows a block diagram of composite imaging steps utilized in one embodiment. First, an original is scanned by the scanning section 98 (Step 200). Next, annotated image data is received from a source and stored in a memory such as memory 122 (Step 202). A copy sheet is then fed from a supply 134 through the transport path and registered as it travels through the path (Step 204). While this is being done, the original image is being scanned onto the photoreceptor by the ROS 106 (Step 206). As the copy sheet passes annotator 86, an annotated image is printed on the copy sheet (Step 208). After the original is imaged onto the photoreceptor, the copy sheet containing the annotated image passes by the transfer station D where the image is transferred from the photoreceptor belt to the copy sheet (Step 210). The copy sheet then travels past a fusing station (Step 212) and on towards an output tray (Step 214).

The invention has been described with reference to the preferred embodiments thereof, which are illustrative and not limiting. Various changes may be made without departing from the spirit and scope of the invention as defined in the appended claims.

What is claimed is:

1. A one color copying machine capable of color annotation in a different color of the type having a transporting means for transporting a copy sheet along a transport path from an entrance location to an outlet location; a recording member; charging means for uniformly charging the recording member in preparation for imaging; means for exposing the recording member to produce a latent electrostatic copy image on the recording member; developing means for developing the image on the recording member; transfer means for transferring the developed image to a copy sheet to reproduce an original; and a fuser assembly for fusing developed images onto the copy sheet, said recording member, charging means, exposing means, developing means, transfer means and fuser assembly being located along said transport path, the machine further comprising:

a memory capable of storing annotated image data;

a thermal ink jet printing array, of a color, other than said one color copying machine, located along said transport path between said transfer means and said fuser assembly; and control means for controlling printing of annotated image data by said thermal ink jet printing array onto said copy sheet after transfer of a first unfused image portion to said copy sheet by said copying machine and before fusing by said fuser assembly.

2. A printing device comprising a black-only electrophotographic printing assembly and a thermal ink jet printing assembly capable of forming a composite image, comprising:

first data supplying means for supplying a first set of data signals representing a first portion of an image to be reproduced, the first portion being scanned from an original document;

second data supplying means separate from said first data supplying means for supplying a second set of data signals representing a second portion of an image to be reproduced:

receiving means for receiving and storing said first set of data signals and said second set of data signals;

a black-only electrophotographic printing assembly located along a copy sheet transport path;

a fuser located downstream of said electrophotographic printing assembly along said sheet transport path; and a thermal ink jet printing assembly located between said electrophotographic printing assembly and said fuser along said sheet transport path, wherein said first set of data signals is used to form an unfused first image portion onto a copy sheet using said electrophotographic printing assembly and said second set of data signals is used to form a second image portion onto the copy sheet using said thermal ink jet printing assembly, said second image being formed onto the copy sheet prior to fusing of said first portion.

3. The apparatus of claim 2, wherein said second data supplying means includes at least one device from the group consisting of a personal computer, a word processor, a User Interface and a facsimile machine.

4. The apparatus of claim 2, further including an inverting means for inverting said second set of data signals prior to printing to provide an inverted black outline wherein a black outline of said second set of data signals is printed using said electrophotographic printing assembly and an inner fill area of said second set of data signals is printed using said thermal ink jet printing assembly.

5. A method of forming a composite color image, comprising the steps of:

(a) receiving a first set of data signals representing a first portion of an image to be reproduced;

(b) receiving a second set of data signals representing a second portion of an image to be reproduced;

(c) inverting said second set of data signals to provide a negative image having a black outline and colored inner fill area;

(d) printing the first portion of the image and said black outline of said inverted second set of data signals using electrophotographic printing assembly in a first resolution; and (e) printing the colored inner fill area of said second portion of the image on top of the first portion using a thermal ink jet printing assembly in a second, lower resolution.

6. A method of forming a composite color image using a xerographic device having an electrophotographic printing assembly with a single, black-only developer unit, comprising the steps of:

(a) receiving a first set of data signals representing at least a portion of an original document;

(b) receiving a second set of data signals representing a color portion of said composite color image;

(c) transporting a copy sheet along a transport path within the xerographic device past a black-only electrophotographic printing assembly;

(d) utilizing said first set of data signals to print an unfused first portion of said composite image on said copy sheet using said black-only electrophotographic printing assembly;

(e) transporting said copy sheet to a thermal ink jet printing assembly located along said transport path; and (f) utilizing said second set of data signals to print a second portion of said composite image on said copy sheet in a color other than black using said thermal ink jet printing assembly, said step being performed prior to fusing of said unfused first portion.

7. The method of claim 6, wherein said step of printing with said xerographic printing assembly prints at a higher resolution than said step of printing with said thermal ink jet printing assembly.

8. The method of claim 7, wherein one set of said data signals are inverted prior to printing to provide a negative image.

9. The method of claim 1, wherein said step of printing with said thermal ink jet printing assembly prints at a resolution substantially the same as said electrophotographic printing assembly.

10. The method of claim 6, wherein a drying step is performed after step (e) to dry both the first portion and the second portion simultaneously.

11. The method of claim 10, wherein said drying step is performed by a fuser assembly.

* * * * *